US007168871B2

(12) United States Patent
Tsugaru

(10) Patent No.: US 7,168,871 B2
(45) Date of Patent: Jan. 30, 2007

(54) RIBBON TAKEUP DEVICE AND PRINTER WITH RIBBON TAKEUP DEVICE

(75) Inventor: Hiroyuki Tsugaru, Saitama (JP)

(73) Assignee: Citizen Watch Co., Ltd., Tokyo (JP)

( * ) Notice: Subject to any disclaimer, the term of this patent is extended or adjusted under 35 U.S.C. 154(b) by 151 days.

(21) Appl. No.: 10/980,430

(22) Filed: Nov. 4, 2004

(65) Prior Publication Data

US 2005/0100379 A1 May 12, 2005

(30) Foreign Application Priority Data

Nov. 6, 2003 (JP) ..... 2003-376718

(51) Int. Cl.
*B41J 33/18* (2006.01)

(52) U.S. Cl. ..... 400/236.1; 400/225

(58) Field of Classification Search ..... None
See application file for complete search history.

(56) References Cited

U.S. PATENT DOCUMENTS 2,744,605 A * 5/1956 Gearheart et al. ..... 400/219.5
3,037,448 A * 6/1962 Blodgett et al. ..... 101/336
4,214,838 A * 7/1980 Gassowski ..... 400/220.1
4,381,155 A * 4/1983 Kondur, Jr. ..... 400/220.1
4,494,887 A * 1/1985 Wincent ..... 400/568

FOREIGN PATENT DOCUMENTS

JP 01-278385 11/1989
JP 02-117874 5/1990

* cited by examiner

*Primary Examiner*—Daniel J. Colilla
(74) *Attorney, Agent, or Firm*—Westerman, Hattori, Daniels & Adrian, LLP.

(57) ABSTRACT

The present invention reduces the peak torque of a motor used in a ribbon takeup mechanism and makes the motor, used for driving, smaller and less costly. A ribbon takeup device includes ratchet wheels (5) provided on ribbon takeup axes (4), a feed claw (6) that engages the ratchet wheels, a displacement member (9) driven and displaced by a motor (11) so that at least a linear displacement is given, a slide member (3) that moves the feed claw, and an elastic member (15). The configuration is that the elastic member engages the slide member that has the ribbon feed claw for taking up a ribbon and, with force applied to the slide member into one direction by the elastic member, a motor driving force is added to the slide member into the same direction as the direction in which the elastic member applies force. This configuration allows the elastic member and the motor to share the load of ribbon feeding and the load of ribbon feed claw switching, reduces the required motor torque, and makes it possible to employ a less powerful, less costly motor.

11 Claims, 17 Drawing Sheets

PRIOR ART

PRIOR ART

PRIOR ART

RIBBON TAKEUP DEVICE AND PRINTER WITH RIBBON TAKEUP DEVICE

BACKGROUND OF THE INVENTION

1. Field of the Invention

The present invention relates to the ribbon takeup device of an inked ribbon device and to a printer.

2. Description of the Related Art

For a ribbon takeup mechanism used in an inked ribbon device mounted on a small printer, some are known as mechanisms for taking up a ribbon such as a mechanism that uses the tensile force of a tension spring and a mechanism that uses the drive torque of a motor, are known (see Patent Document 1, Patent Document 2).

FIG. 13 is a general diagram showing a mechanism that takes up an inked ribbon by the tensile force of a tension spring.

Referring to FIG. 13, a ribbon takeup mechanism 101 has a pair of ribbon takeup axes 104, each with a ratchet wheel 105, on a ribbon frame 102. Ribbon spools 110, on which a ribbon 116 is wound, are mounted on this pair of ribbon takeup axes 104.

A ribbon feed plate 103 is slidably installed on the ribbon frame 102, with a tension spring 115 between the ribbon frame 102 and the ribbon feed plate 103. A feed claw 106 is provided on the ribbon feed plate 103. The feed claw 106 engages the ratchet wheel 105 through the tensile force of the tension spring 115 to drive the ribbon takeup axes 104. A motor-driven cam 109 is used to stretch the tension spring 115, and the ribbon takeup axes 104 are driven by the tensile force of the stretched tension spring 115 that tends to restore to its original position.

FIG. 14 is a diagram showing how the ribbon takeup mechanism described above drives the ribbon feed plate. Referring to FIG. 14, the tension spring 115 always applies force to the ribbon feed plate 103 into the direction indicated by the arrow. From FIG. 14(*a*) to FIG. 14(*e*), the ribbon feed plate 103 moves to the left in the figure as the cam 109 rotates. During this time, the tension spring 115 is stretched. Next, from FIG. 14(*f*) to FIG. 14(*h*), the ribbon feed plate 103 moves to the right in the figure by the tensile force of the stretched tension spring 115 that tends to restore to its original position.

When the ribbon feed plate 103 moves to the right as shown in FIG. 14(*f*) to FIG. 14(*h*), the feed claw engages the ratchet wheel to rotate the ribbon takeup axes and takes up the ribbon.

FIG. 15 is a general diagram showing the motor-driven mechanism for taking up an inked ribbon.

As with the configuration shown in FIG. 13, a ribbon takeup mechanism 111 shown in FIG. 15 has a pair of ribbon takeup axes 104, each with the ratchet wheel 105, on the ribbon frame 102. The ribbon spools 110, on which a ribbon 116 is wound, are mounted on this pair of ribbon takeup axes 104.

A ribbon feed plate 113 is slidably installed on the ribbon frame 102. The feed claw 106 is provided on the ribbon feed plate 113. As the ribbon feed plate 113 moves, the feed claw 106 engages the ratchet wheel 105 to drive the ribbon takeup axes 104.

The ribbon feed plate 113 has an arm 113*a* that has a drive mechanism at its end. The drive mechanism comprises a slit 113*b* formed at the end of the arm 113*a* and a gear 119 having a column 119*a* that slides along the opposed sliding surfaces 113*c* of the slit 113*b*. When the gear 119 rotates, the column 119*a* slides along one of the sliding surfaces 113*c* in the slit 113*b* to cause the ribbon feed plate 113 to reciprocate linearly.

FIG. 16 is a diagram showing how the ribbon takeup mechanism described above drives the ribbon feed plate. Referring to FIG. 16, the ribbon feed plate 113 is driven by the motor through the gear, the column, and the sliding surfaces. As the gear is rotated by the motor, the ribbon feed plate 113 moves to the left in the figure from FIG. 16(*a*) to FIG. 16(*e*) and, after that, to the right from FIG. 16(*f*) to FIG. 16(*h*).

When the ribbon feed plate 113 moves to the right in the figure from FIG. 16(*f*) to FIG. 16(*h*), the feed claw engages the ratchet wheel to rotate the ribbon takeup axes and takes up the ribbon.

[Patent Document 1] Japanese Patent Laid-Open Publication No. Hei 01-278385

[Patent Document 2] Patent Application No. 3002780

The ribbon takeup mechanism that drives the ribbon takeup axes through a tension spring described above drives the ribbon takeup axes only through the tensile force of the tension spring, meaning that a tension spring must have the tensile force exceeding the load of the ribbon takeup axes. The problem here is that the ribbon takeup axes that have a heavy load require a greater tensile force of the tension spring.

The load of the ribbon takeup axes includes a load generated at a ribbon feed time as well as a load generated when the ribbon feed claw is switched from the ratchet wheel of one ribbon takeup axis to the ratchet wheel of the other ribbon takeup axis when the movement direction of the ribbon is reversed. When the ribbon feed claw is switched through the tensile force of the tension spring, a load heavier than the load at a ribbon feed time is generated. Therefore, a greater tensile force of the tension spring is required and a heavy load is applied to the motor. Another problem is that the motor drive efficiency becomes low because the motor drives the mechanism always under the load of the tensile force of the tension spring.

In FIG. 17(*a*), the left to the broken line indicates the period of time during which the tension spring is stretched. In this period, the ribbon feed plate is moved to the position where the ribbon feed claw engages the ratchet wheel. The right to the broken line indicates the period of time during which the tension spring is restored to its original position. The ribbon is fed in this spring restoration period by causing the ribbon feed claw to engage the ratchet wheel to rotate the ribbon takeup axes.

To feed the ribbon, the spring torque T1 exceeding the load, required for feeding the ribbon (chain double-dashed line in the figure), is required during the ribbon feed period. To switch the ribbon feed claw from one ratchet wheel to another, the spring torque T2 exceeding the load, required for switching the ribbon feed claw (dashed line in the figure), is required during the switching period.

The above-described ribbon takeup mechanism that uses a motor to drive the ribbon takeup axes solves the problem of the load of the tension spring mechanism that uses a tension spring. However, because a heavy load must be applied to the motor when the ribbon is switched, the motor requires a large driving torque and therefore a large motor is required.

Referring to FIG. 17(*b*), the left to the broken line indicates the period during which the ribbon feed plate is moved to the position where the ribbon feed claw engages the ratchet wheel, and the right to the broken line indicates the period during which the ribbon is fed. To feed the ribbon, a motor torque exceeding the load, required for ribbon feeding (chain double-dashed line in the figure), is required during the ribbon feed period. To switch the ribbon feed claw from one ratchet wheel to another, a motor torque exceeding the load, required for switching the ribbon feed claw (dashed line in the figure), is required during the switching period.

Normally, the load required for switching the ribbon feed claw is heavier than the load required for feeding the ribbon. Therefore, the peak torque required for the motor is a torque exceeding the load required for switching the ribbon feed claw (dashed line in the figure).

SUMMARY OF THE INVENTION

It is an object of the present invention to solve the problems in the prior art, to reduce the peak torque of the motor used for the ribbon takeup mechanism, and to make the driving motor compact and less costly.

The present invention provides a ribbon takeup device for taking up an inked ribbon comprising ribbon takeup axes for taking up the inked ribbon; a displacement member that moves to selectively rotate the ribbon takeup axes; a motor that moves the displacement member; and a spring member that accumulates energy by the displacement member moving into a direction in which the ribbon takeup axes are not rotated and that releases the accumulated energy by the displacement member moving into a direction in which the ribbon takeup axes are rotated. When the displacement member moves into a direction in which the ribbon takeup axes are rotated, the displacement member varies a ratio between a rotational driving torque by the spring member and a rotational driving torque by the motor according to a load state of the ribbon takeup axes.

Varying this rotational driving torque ratio reduces the peak torque of the motor used in the ribbon takeup mechanism.

The load state is the state of a load required for taking up the inked ribbon and the state of a load required for switching a takeup direction. When the load state is the state of a load required for switching the takeup direction, the ratio of the rotational driving torque by the motor is increased.

The displacement member applies the rotational driving torque of the motor when a load applied to the ribbon takeup axes exceeds a predetermined load, and applies only the rotational driving torque of the spring member when a load applied to the ribbon takeup axes does not exceed a predetermined load.

The predetermined load is a load calculated by subtracting the rotational driving torque by the spring member from the load required for taking up the inked ribbon or the load required for switching the takeup direction.

The ribbon takeup device according to the present invention is configured in such a way that the elastic member engages the slide member that has the ribbon feed claw for taking up a ribbon and, with force applied to the slide member into one direction by the elastic member, a motor driving force is applied to the slide member into the same direction as the direction in which the elastic member applies the force.

This configuration allows the elastic member and the motor to share the load of ribbon feeding and the load of ribbon feed claw switching, reduces the required motor torque, and makes it possible to employ a less powerful, less costly motor.

At a ribbon feeding time when the load of the ribbon takeup axes is light, only the elastic force of the elastic member, not the motor driving force, is used. At a ribbon feed claw switching time when the load of the ribbon takeup axes is heavy, the resultant force of the elastic force of the elastic member and the motor driving force is used. This configuration reduces the peak torque of the motor and makes it possible to employ a less powerful, less costly motor.

The ribbon takeup device according to the present invention comprises ratchet wheels provided on ribbon takeup axes; a feed claw that engages the ratchet wheels; a displacement member that is driven and displaced by a motor so that at least a linear displacement is given; a slide member that moves the feed claw, and an elastic member.

The slide member comprises a first engagement part that engages the displacement member when the feed claw moves into a direction in which the ribbon takeup axes are rotated and a second engagement part that engages the displacement member when the feed claw moves into the opposite direction of the direction described above. The elastic member applies force to the slide member into a direction in which force is applied by the engagement between the displacement member and the first engagement part.

In a period in which the slide member moves into a direction in which the elastic member applies the force, the displacement member switches the engagement of the slide member from the second engagement part to the first engagement part according to a load applied to the ribbon takeup axes.

When the load applied to the ribbon takeup axes exceeds a predetermined load, the displacement member engages the first engagement part of the slide member to apply force to the slide member into a direction into which the force is applied. The feed claw is driven by a resultant force of the elastic force of the elastic member and the motor driving force.

The predetermined load is a load calculated by subtracting the elastic force of the elastic member from a load required for switching the ratchet wheel that engages the feed claw. When the load applied to the ribbon takeup axes exceeds this predetermined load, the feed claw is driven by the resultant force of the elastic force of the elastic member and the motor driving force to switch the engagement between the ratchet wheel of one of a pair of ribbon takeup axes and the feed claw.

The predetermined load is a load calculated by subtracting the elastic force of the elastic member from a load required by the ribbon takeup axes to take up the ribbon. When the load applied to the ribbon takeup axes exceeds this predetermined load, the feed claw is driven by the resultant force of the elastic force of the elastic member and the motor driving force to feed the ribbon.

When the load applied to the ribbon takeup axes does not exceed the predetermined load, the displacement member disengages the first engagement part of the slide member to release the application of force into a direction into which the force is applied to the slide member. The feed claw is driven only by the elastic force of the elastic member, and the ribbon takeup axes are driven only by the elastic force.

A printer according to the present invention has the ribbon takeup device described above.

This present invention reduces the peak torque of the motor used for the ribbon takeup mechanism and makes it possible to employ a compact, less costly motor for driving.

DESCRIPTION OF PREFERRED EMBODIMENT

A ribbon takeup device according to the present invention and a printer on which the ribbon takeup device is installed will be described in detail below with reference to the drawings.

Figure 1:
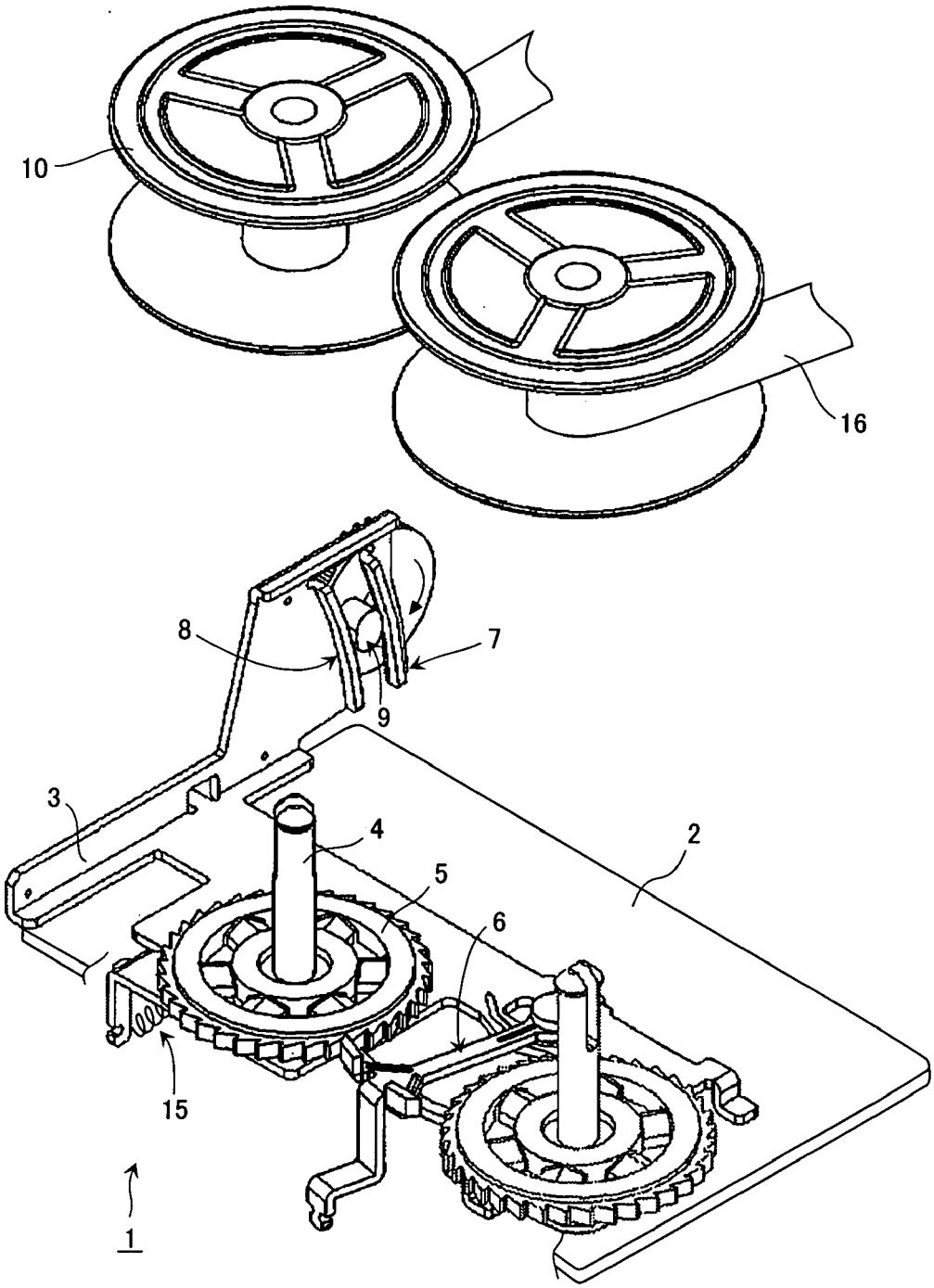
FIG. 1 is a general diagram showing the inked ribbon takeup mechanism of a ribbon takeup device according to the present invention.

FIG. 1 is a general diagram showing a mechanism for taking up an inked ribbon by a ribbon takeup device according to the present invention.

Referring to FIG. 1, a ribbon takeup mechanism 1 has a pair of ribbon takeup axes 4, each with a ratchet wheel 5, on a ribbon frame 2. Ribbon spools 10, on which a ribbon 16 is wound, are mounted on this pair of ribbon takeup axes 4.

Figure 13:
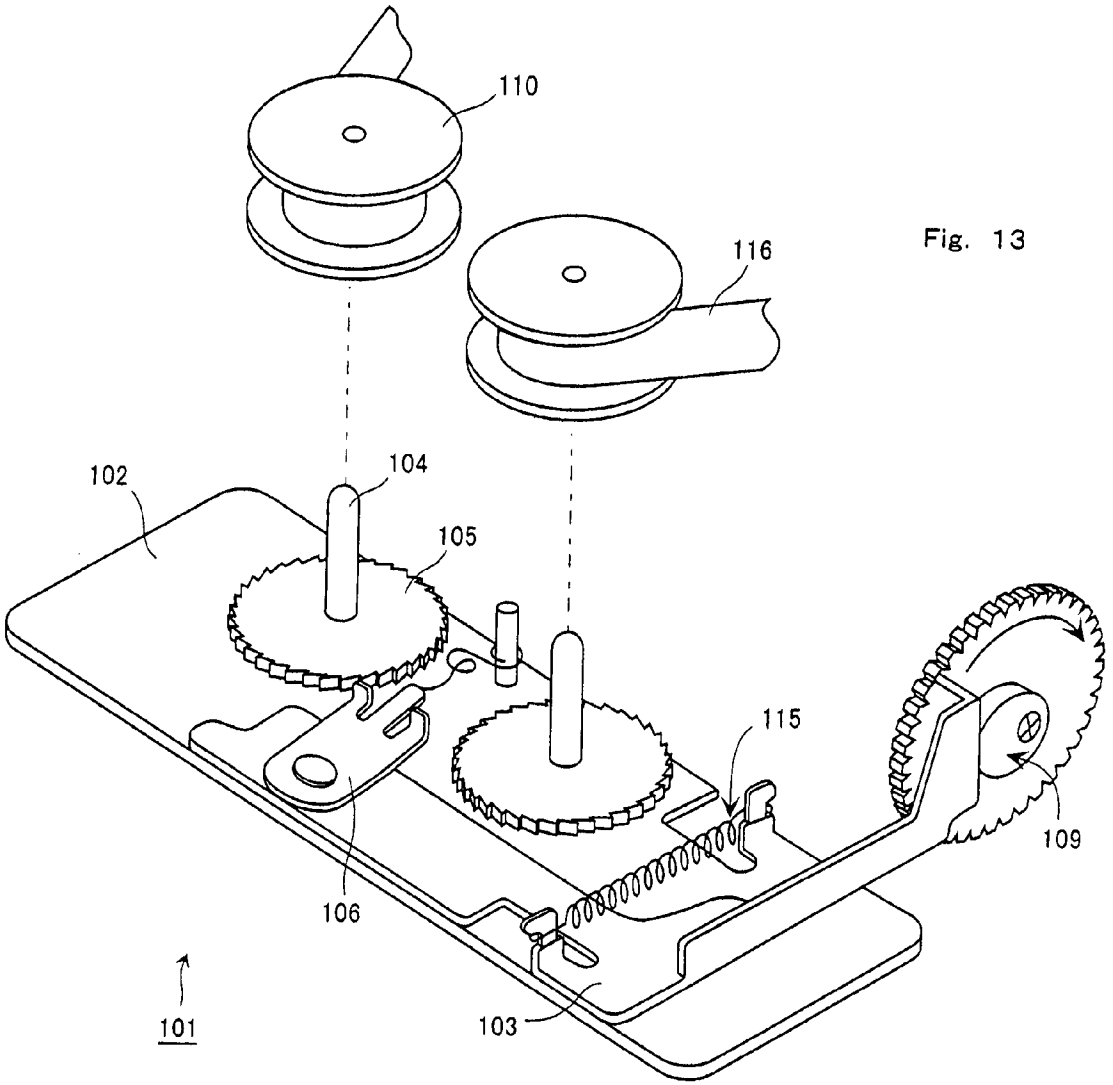
PRIOR ART Fig. 13
FIG. 13 is a general diagram showing a conventional mechanism that takes up an inked ribbon by the tensile force of a tension spring.
Figure 14:
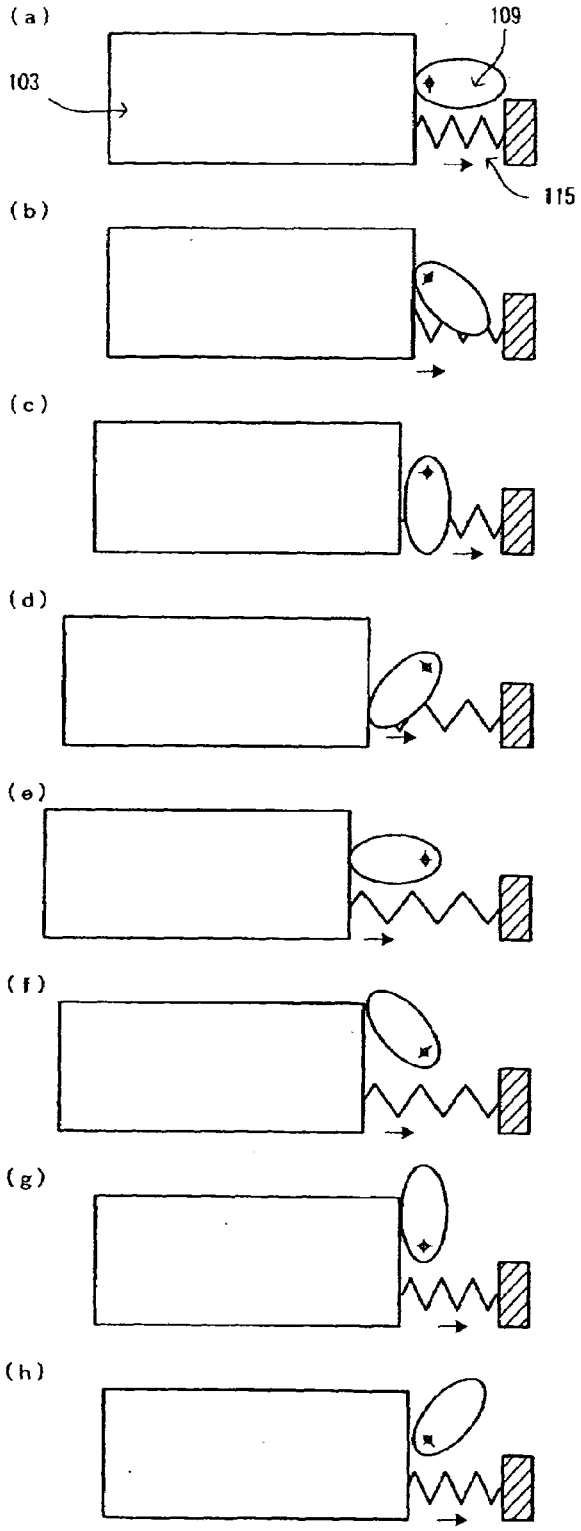
FIG. 14 is a diagram showing how the conventional ribbon takeup mechanism drives the ribbon feed plate.
Figure 15:
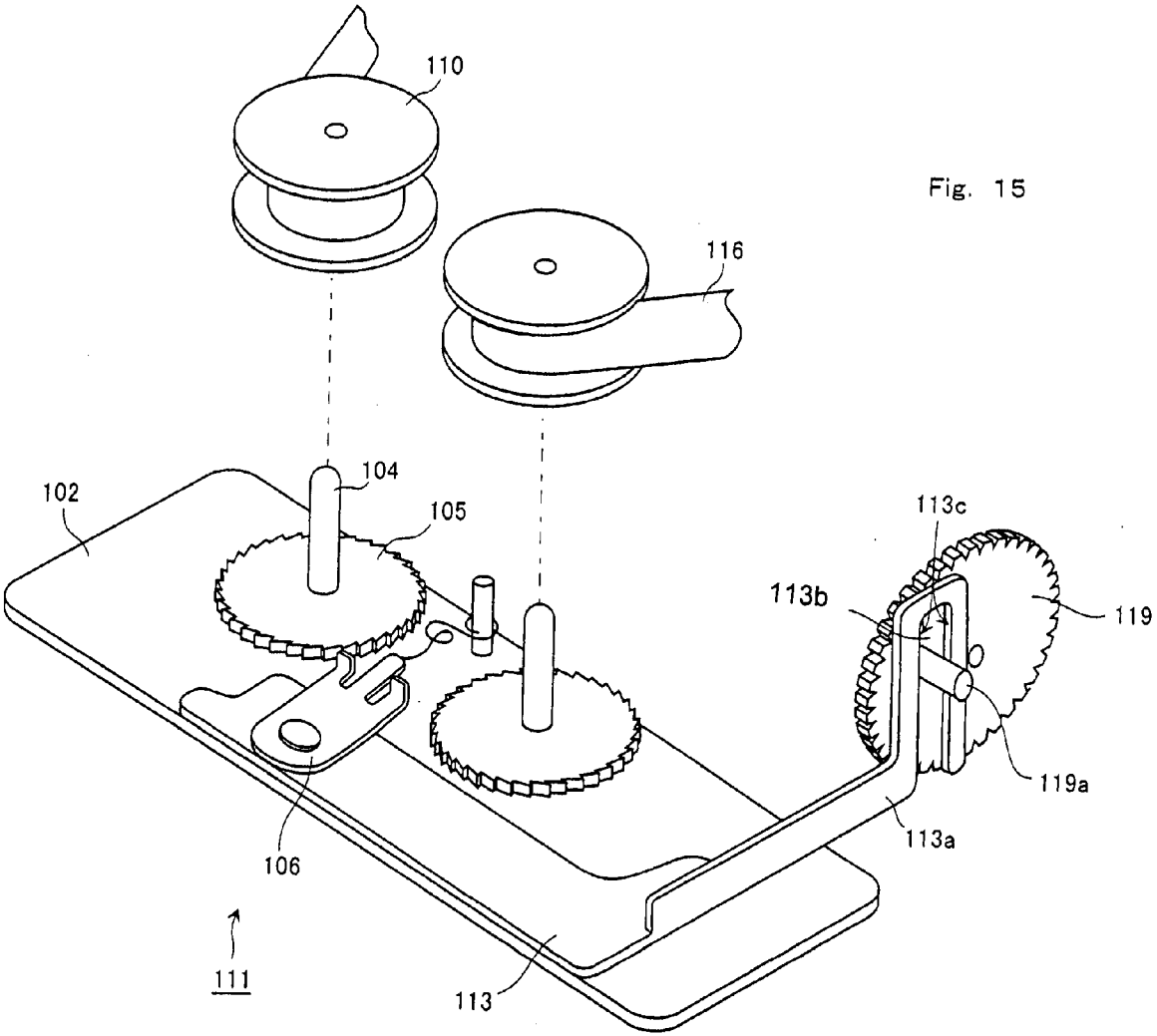
PRIOR ART Fig. 15
FIG. 15 is a general diagram showing a conventional mechanism that takes up an inked ribbon by a motor driving force.
Figure 16:
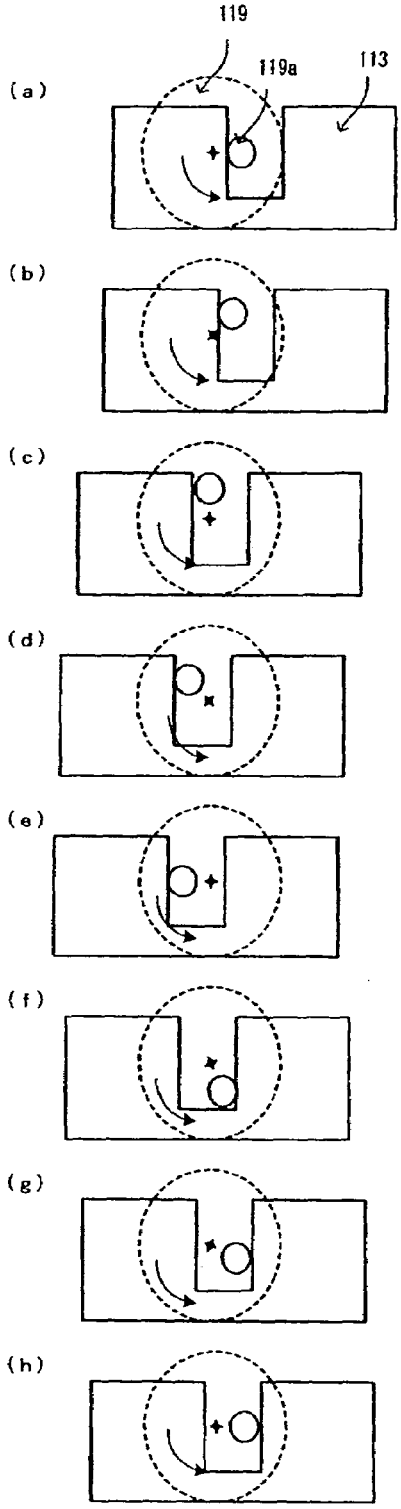
FIG. 16 is a diagram showing how the conventional ribbon takeup mechanism drives the ribbon feed plate.
Figure 17:
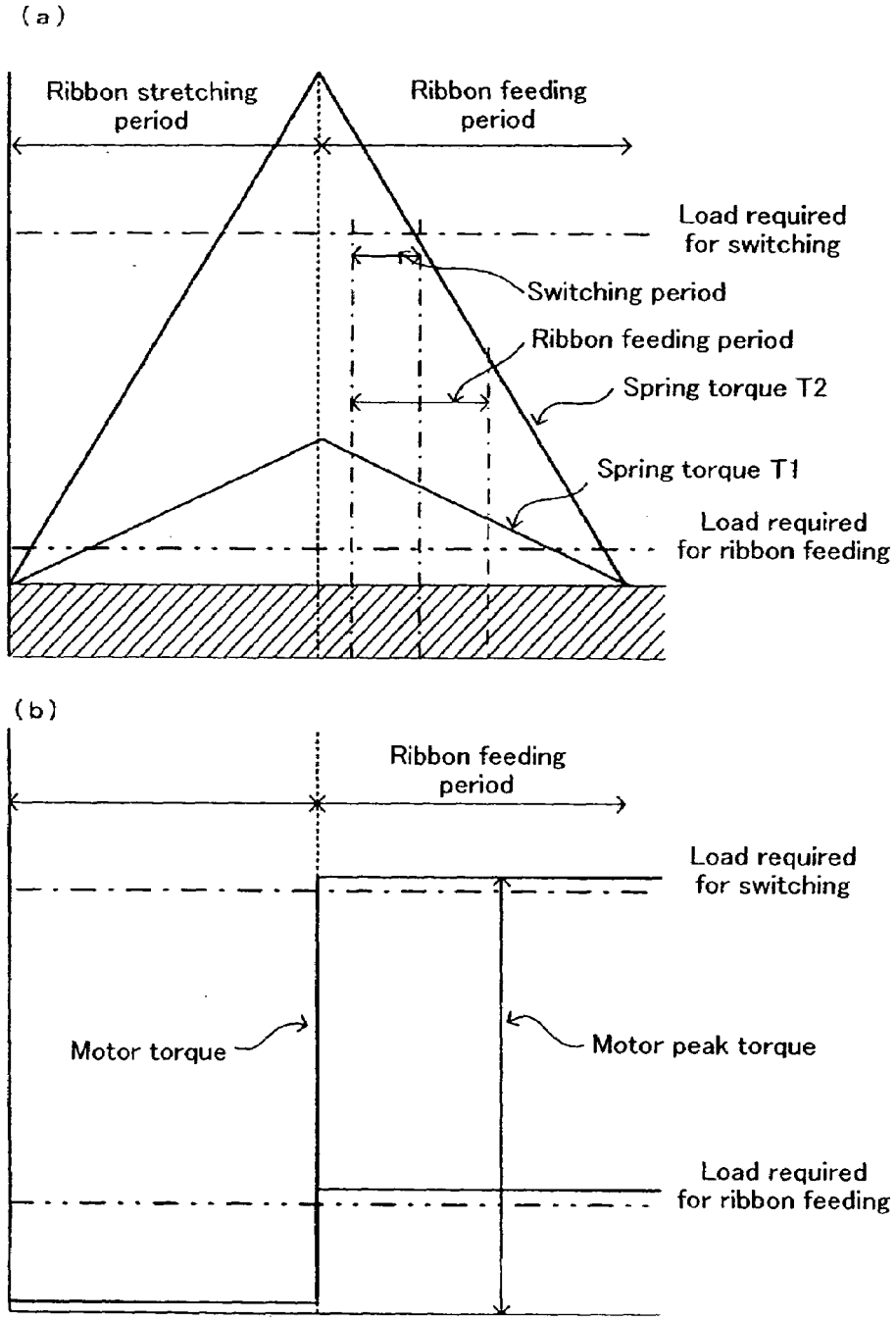
FIG. 17 is a general diagram showing the driving force of the conventional ribbon takeup mechanism when a ribbon is fed and when the feed claw is switched.

A slide member 3 is slidably installed on the ribbon frame 2, with an elastic member 15 such as a tension spring between the ribbon frame 2 and the slide member 3. A feed claw 6 is provided on the slide member 3. The feed claw 6 engages the ratchet wheel 5 to drive the ribbon takeup axes 4. The slide member 3 is similar in operation to the ribbon feed plate, shown in FIGS. 13 and 15, in that it drives the feed claw 6 for feeding a ribbon.

The slide member 3 according to the present invention has a first engagement part 7 and a second engagement part 8 that are not provided on the ribbon feed plate described above. One of the first engagement part 7 and the second engagement part 8 engages a displacement member 9 and linearly reciprocates according to the displacement of the displacement member 9. The displacement member 9 can be configured, for example, by a gear and a columnar member installed eccentrically with respect to the rotation axis of the gear. The displacement member 9 moves eccentrically as the gear rotates and engages one of the first engagement part 7 and the second engagement part 8 to cause the slide member 3 to reciprocate linearly.

The elastic member 15 moves the slide member 3 so that the feed claw 6 engages the ratchet wheel 5 to move the ribbon takeup axes 4 into the ribbon takeup direction.

On the other hand, the second engagement part 8 on the slide member 3, which engages the displacement member 9, is driven by the motor to stretch the elastic member 15. This causes the feed claw 6 to move to the position where it engages the ratchet wheel 5.

The first engagement part 7 on the slide member 3, which engages the displacement member 9, is driven by the motor to restore the elastic member 15 back to its original position. This movement direction is the direction in which the feed claw 6 that engages the ratchet wheel 5 drives the ribbon takeup axes 4 to feed the ribbon or to switch the feed claw 6.

At this time, the load generated by the engagement between the feed claw 6 and the ratchet wheel 5 or the load generated by the switching of the feed claw 6 is born by the resultant force of the elastic force of the elastic member 15 (for example, the force of a stretched spring to restore to its original position) and the motor driving force transmitted via the engagement between the displacement member 9 and the second engagement part 8. Therefore, when the load is high, for example, when the feed claw 6 is switched, the resultant force of the elastic force and the motor driving force is used. This structure makes the elastic member small, reduces the peak torque of the motor, and makes the motor compact.

Because the load generated by the engagement between the feed claw 6 and the ratchet wheel 5 for feeding the ribbon is low, only the elastic force of the elastic member 15 may be used without using the motor driving force.

Figure 2:
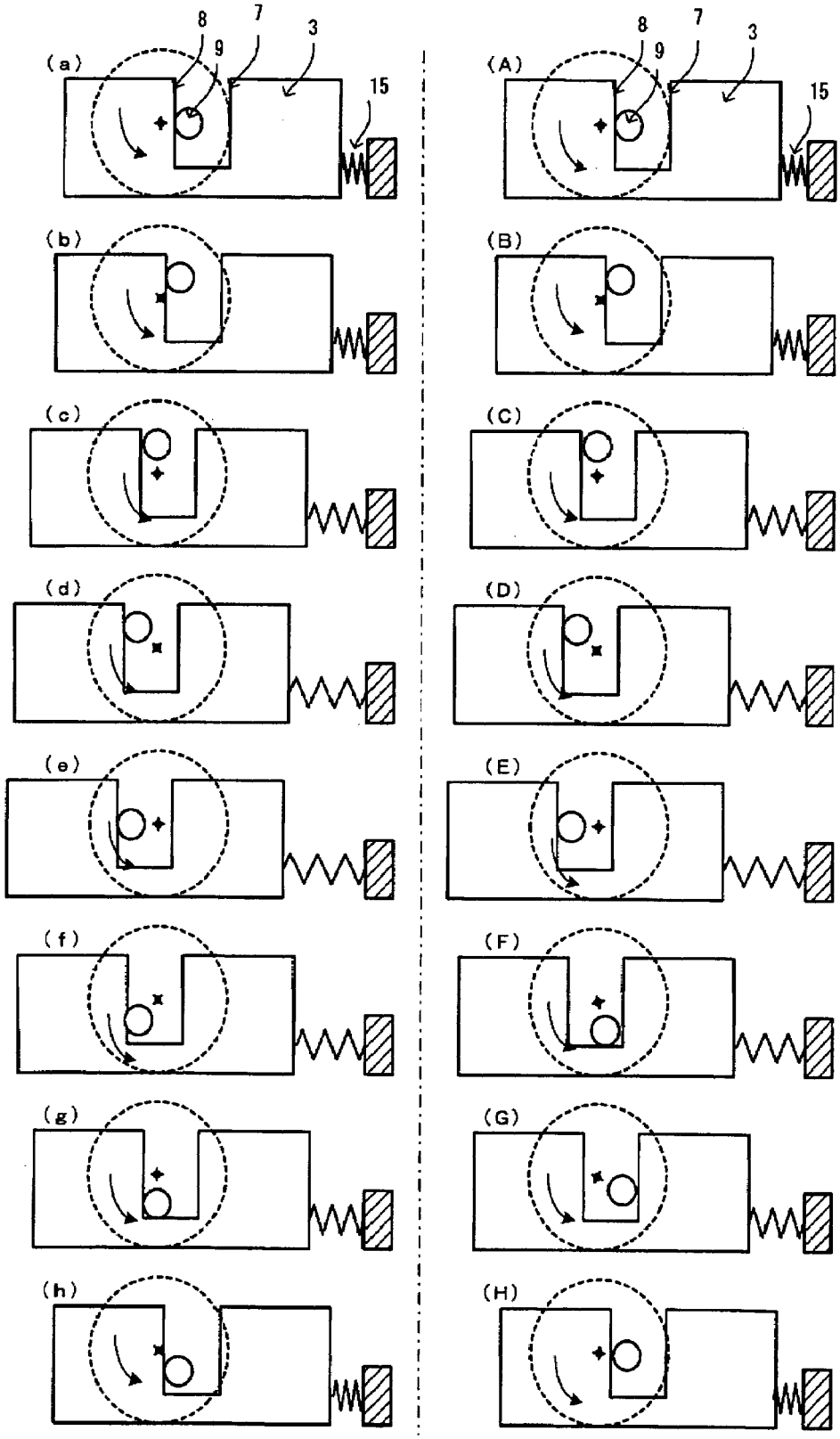
FIG. 2 is a diagram showing how the ribbon takeup mechanism according to the present invention drives the slide member.

FIG. 2 is a diagram showing how the slide member of the ribbon takeup mechanism according to the present invention is driven. Referring to FIG. 2, the elastic member 15 always applies force to the slide member 3 into the direction indicated by the arrow.

FIGS. 2(A) to 2(H) show how the slide member is moved into the ribbon feed direction by the resultant force of the elastic force of the elastic member 15 and the motor driving force when the ribbon takeup axes are driven and the feed claw is switched. FIGS. 2(*a*) to 2(*h*) show how the slide member is moved into the ribbon feed direction only by the elastic force of the elastic member 15 when the ribbon takeup axes are driven.

From FIG. 2(A) to FIG. 2(E), the displacement member 9 engages the second engagement part 8 of the slide member 3 as the gear rotates and moves the slide member 3 to the left in the figure against the elastic force of the elastic member 15. At this time, when the elastic member 15 is a tension spring, the spring is stretched. During the operation shown in FIGS. 2(A) to 2(E), the feed claw engages the ratchet wheel to move the ribbon into the direction in which the ribbon is wound.

Next, from FIG. 2(F) to FIG. 2(G), the slide member 3 moves to the right in the figure by the resultant force of the elastic force of the elastic member and the motor driving force. During this period, the displacement member 9 engages the first engagement part 7 of the slide member 3 as the gear rotates. This engagement drives the slide member 3 by the motor driving force. The slide member 3 is also driven by the elastic force of the elastic member. When the elastic member is a tension spring, the elastic force of this elastic member is the tensile force generated by the tension spring to restore to its original position.

When the slide member 3 moves to the right in FIGS. 2(F) to 2(H), the feed claw engages the ratchet wheel to rotate the ribbon takeup axes for taking up the ribbon or switching the feed claw.

Next, an example of the operation in FIGS. 2(*a*) to 2(*h*) will be described. Because the load on driving the ribbon takeup axes at a ribbon feed time is light, the slide member can be moved into the ribbon feed direction only by the elastic force of the elastic member 15.

From FIG. 2(*a*) to FIG. 2(*e*), the displacement member 9 engages the second engagement part 8 of the slide member 3 as the gear rotates and moves the slide member 3 to the left in the figure against the elastic force of the elastic member 15, as in FIGS. 2(A) to 2(E) described above. At this time, when the elastic member 15 is a tension spring, the spring is stretched. During the operation shown in FIGS. 2(*a*) to 2(*e*), the feed claw engages the ratchet wheel to move the ribbon into the direction in which the ribbon is wound.

Next, from FIG. 2(*f*) to FIG. 2(*g*), the slide member 3 moves to the right in the figure only by the elastic force of the elastic member. During this period, the displacement member 9 engages the second engagement part 8 of the slide member 3 as the gear rotates and does not work as a driving force to move the slide member 3 to the right in the figure. The slide member 3 is driven only by the elastic force of the elastic member. When the elastic member is a tension spring, the elastic force of this elastic member is the tensile force generated by the tension spring to restore to its original position.

Figure 3:
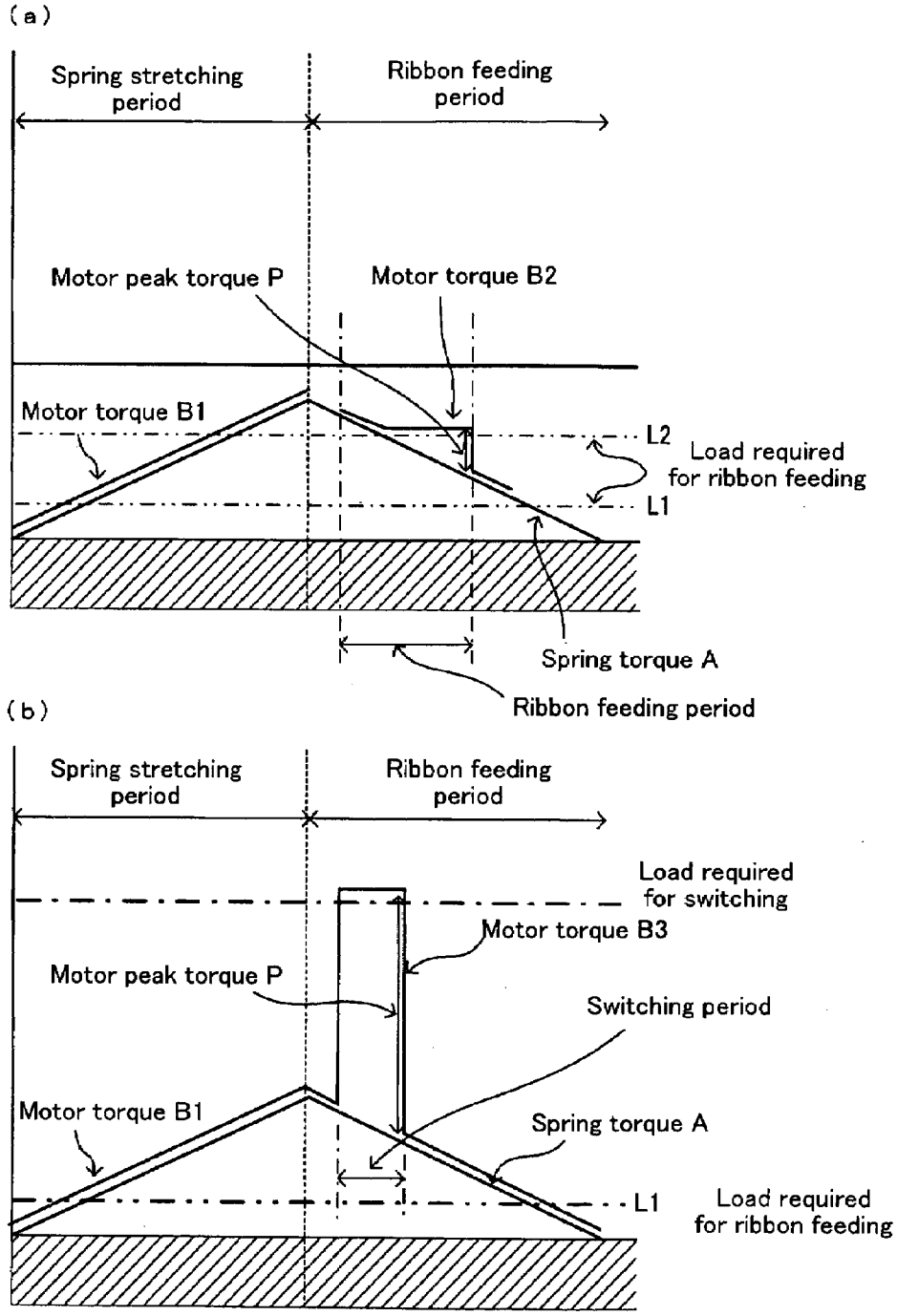
FIG. 3 is a general diagram showing a driving force applied when a ribbon is fed and when the feed claw is switched.

FIG. 3 is a general diagram showing the driving force required for feeding a ribbon and the driving force required for switching the feed claw. In FIG. 3, a tension spring is used as the elastic member, the spring torque in the figure indicates an elastic force, and the motor torque indicates a motor driving force. The left to the broken line in the center of the figure indicates the movement period in which the spring is stretched, while the right to the broken line indicates the movement period in which the stretched spring is restored.

FIG. 3(*a*) indicates the relation between the spring torque and the motor torque when a ribbon is fed, and FIG. 3(*b*) indicates the relation between the spring torque and the motor torque when the feed claw is switched.

In FIGS. 3(*a*) and 3(*b*), the movement period in which the spring is stretched (period to the left of the broken line in the figure) is a period in which the feed claw is moved to the position where it engages the ratchet wheel. In this period, the load is low because neither the ribbon is fed nor the feed claw is switched. Therefore, the motor torque B1 required to move the slide member is only required to slightly exceed the spring torque A.

On the other hand, the movement period in which the spring is restored (period to the right of the broken line in the figure) in FIGS. 3(*a*) and 3(*b*) is a period in which the feed claw drives the ratchet wheel to rotate the ribbon takeup axes to feed a ribbon or to switch the feed claw.

FIG. 3(*a*) indicates the state in which the ribbon is fed in this movement period. When the load on ribbon feeding is L1 in the figure, the spring torque A but not the motor torque is required for driving because the spring torque A is larger than the load L1 in the ribbon feed period. When the load on ribbon feeding is L2 (>L1) in the figure, the motor torque B2 is added and the resultant force of the spring torque A and the motor torque B2 is used for driving because the spring torque A is smaller than the load L2 in the ribbon feed period.

FIG. 3(*b*) indicates the state in which the feed claw is switched in the movement period described above. When the load on feed claw switching is L3 in the figure, the motor torque B3 is added and the resultant force of the spring torque A and the motor torque B3 is used for driving because the spring torque A is smaller than the load L3 in the switching period.

Therefore, the motor peak torque P required for the operation described above is the maximum torque of the motor torque B3 required in the switching period. This peak torque P can be calculated by subtracting the spring torque A from the load L3 required for switching, meaning that this peak torque is smaller than the peak torque required for driving the total load L3 required for switching.

The torque becomes the peak torque P at the end of the switching period. Note that the peak torque P in FIG. 3 is shifted from the end of the switching period for convenience of description.

Figure 4:
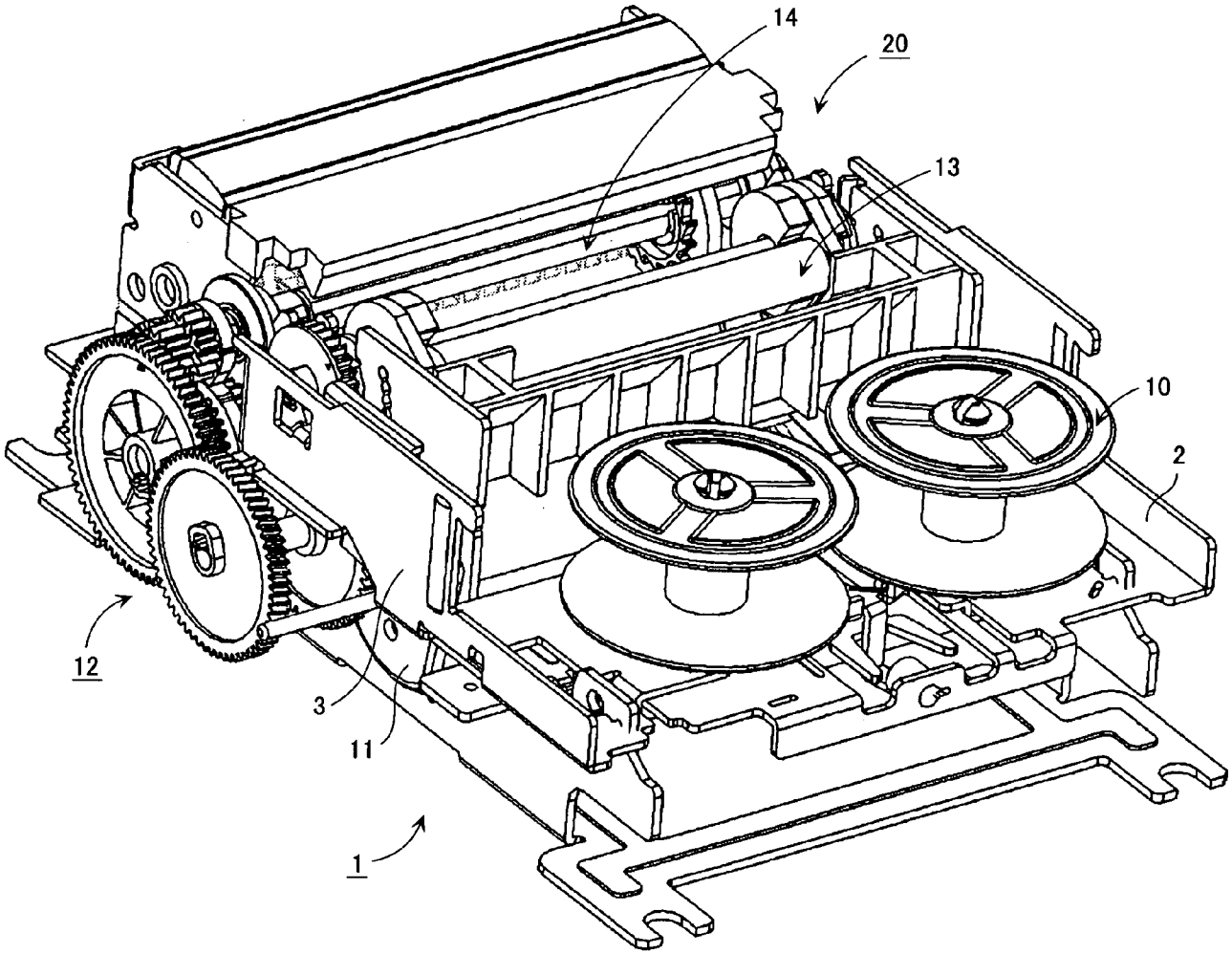
FIG. 4 is a diagram showing the ribbon takeup device and a printer according to the present invention on which ribbon spools are mounted.
Figure 5:
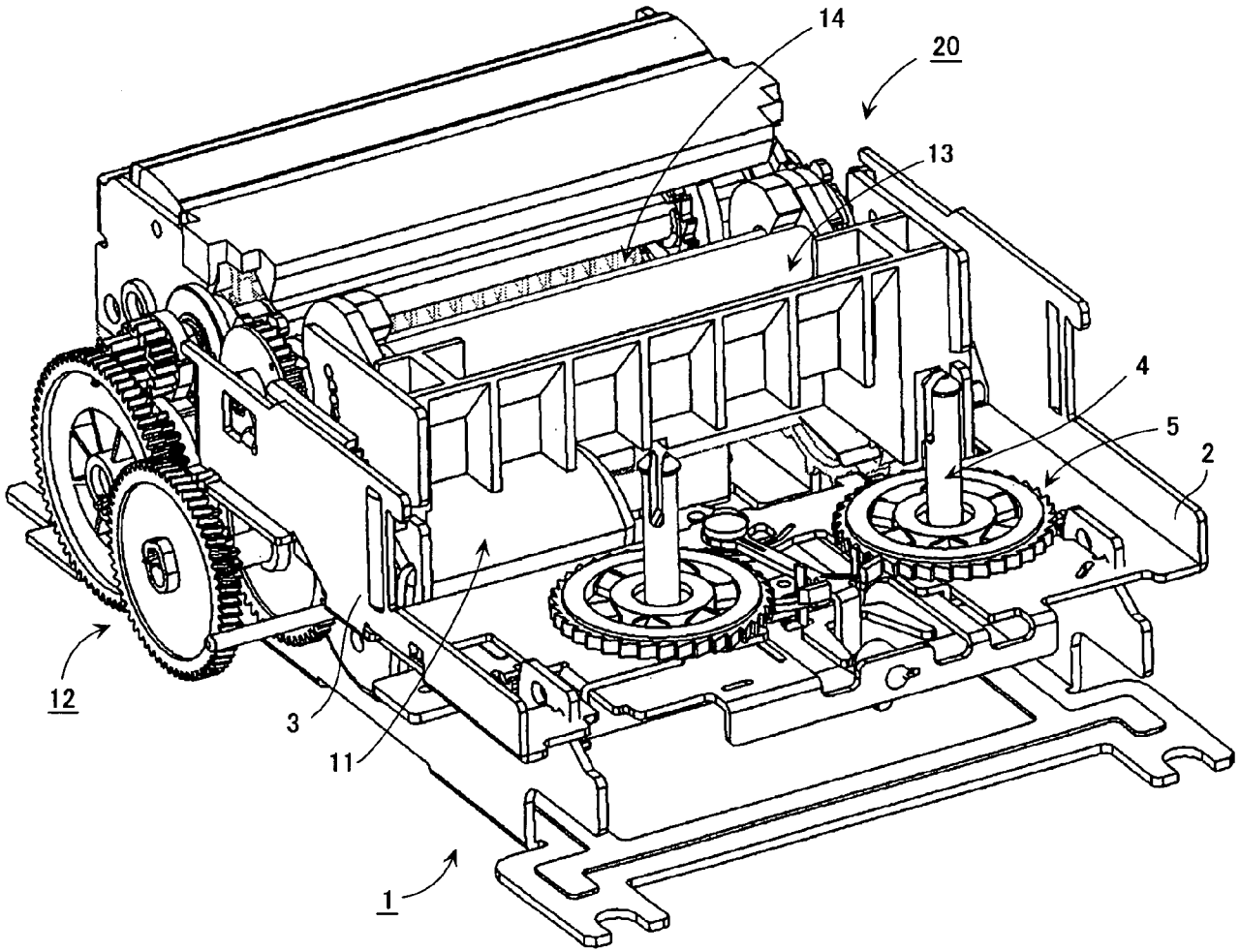
FIG. 5 is a diagram showing the ribbon takeup device and the printer according to the present invention from which ribbon spools are removed.
Figure 6:
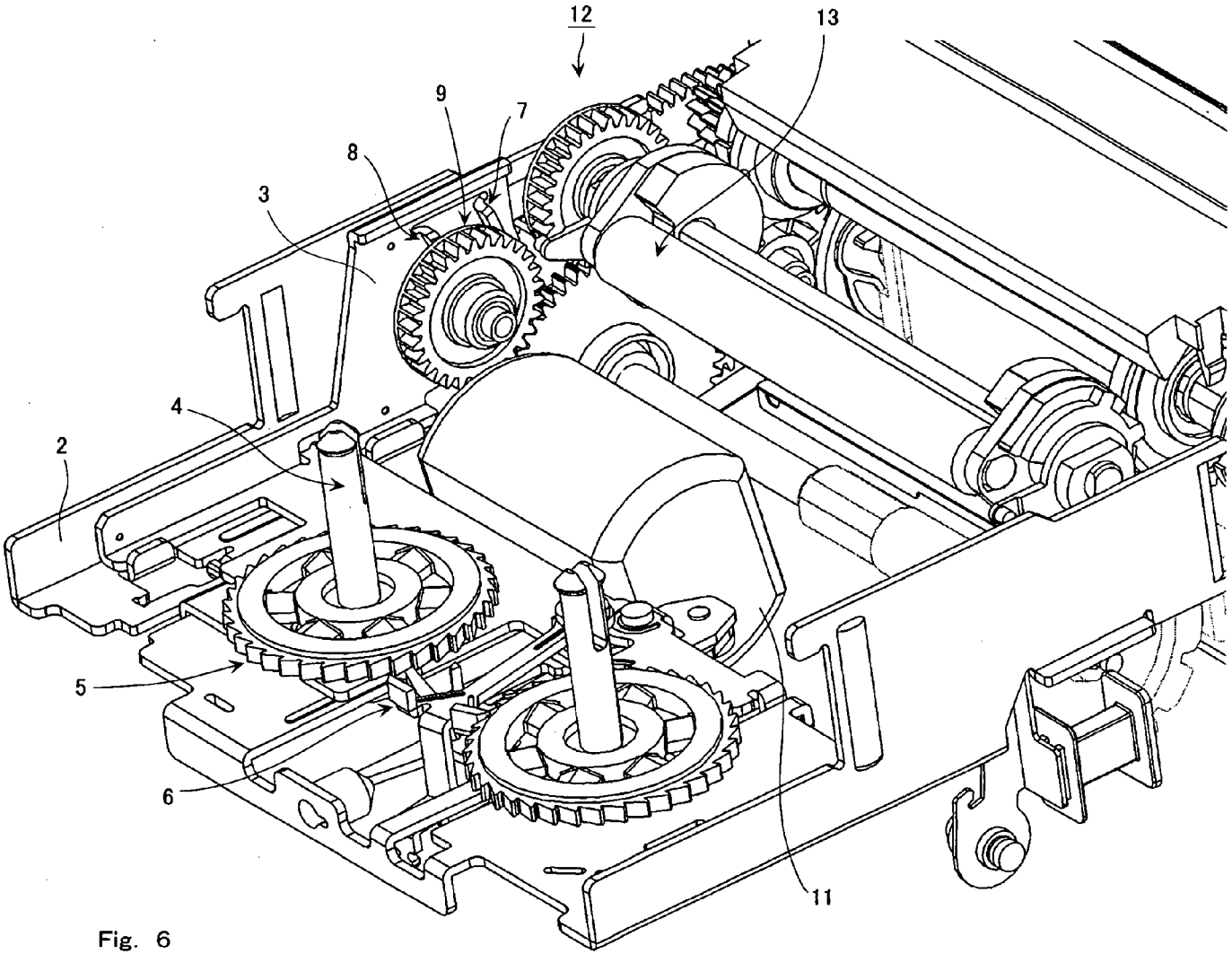
FIG. 6 is a diagram showing the ribbon takeup device and the printer according to the present invention from which ribbon spools are removed.
Figure 7:
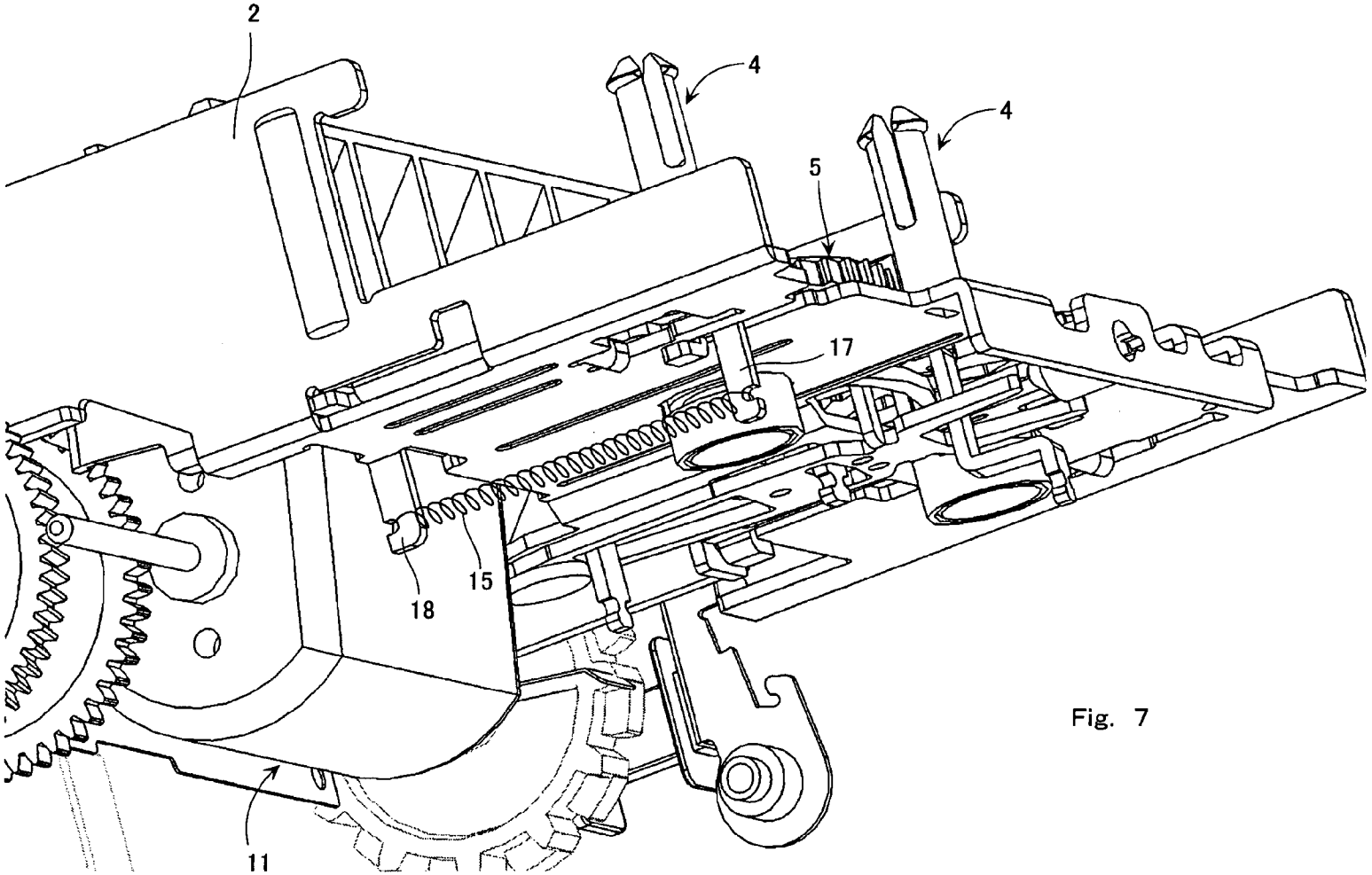
FIG. 7 is a diagram showing the ribbon takeup device the printer according to the present invention viewed from the bottom.

Next, an example of the configuration of the ribbon takeup device according to the present invention and a printer with the ribbon takeup device will be described with reference to FIGS. 4 to 12. FIG. 4 to FIG. 7 are the general diagrams showing a part of the printer. FIG. 4 is a diagram showing the printer on which a ribbon spool is mounted, FIGS. 5 and 6 are diagrams showing the printer from which a ribbon spool is removed, and FIG. 7 is a diagram showing the printer viewed from the bottom.

Referring to FIGS. 4 to 7, a printer 20 comprises a platen 13 and a type unit 14, which are opposed each other, and the ribbon takeup mechanism 1. Those components are driven by the driving force of a motor 11 that is transmitted via the transmission mechanism such as gears 12.

The ribbon takeup mechanism 1 has a pair of ribbon takeup axes 4, each with the ratchet wheel 5, on the ribbon frame 2. The ribbon spools 10, on which the ribbon 16 is wound, are mounted on this pair of ribbon takeup axes 4. The ribbon takeup mechanism 1 intermittently rotates the ribbon takeup axes 4 in synchronization with the print operation by the platen 13 and the type unit 14 to feed the ribbon, wound on the ribbon spools 10, into a predetermined direction. The ribbon feed direction is determined by which ratchet wheel 5 the feed claw 6 engages, that is, the ratchet wheel 5 of one of the ribbon takeup axes 4 of the pair of ribbon takeup axes 4. The ribbon feed direction is reversed when the ribbon takeup axis 4 that the feed claw 6 engages is switched from one ribbon takeup axis 4 to another.

The feed claw is switched when the ribbon on one of the ribbon spools 10 is wound up onto the other ribbon spool 10 and the ribbon takeup axes 4 stop. In this case, the tensile force of the ribbon between the ribbon spools 10 shifts the support axis of the feed claw 6 to cause the feed claw 6 to be shifted into the side of the other ribbon takeup axes 4. This shift of the support axis of the feed claw 6 generates a predetermined load.

The ribbon takeup axes 4 are rotably mounted, and the slide member 3 is slidably mounted, on the ribbon frame 2 with an elastic member (not shown) such as a tension spring between the ribbon frame 2 and the slide member 3. The feed claw 6 is provided on the slide member 3. The feed claw 6 engages the ratchet wheel 5 to drive the ribbon takeup axes 4.

FIG. 6 shows a part of the slide member 3. The slide member 3 comprises the first engagement part 7 and the second engagement part 8. The displacement member 9 such as a cam engages one of the engagement parts to cause the slide member 3 to linearly reciprocate. In FIG. 6, the displacement member 9 is hidden behind the gear.

The driving force of the motor 11 drives not only the platen 13 and the type unit 14 via gears 12 but also the displacement member 9.

Figure 8:
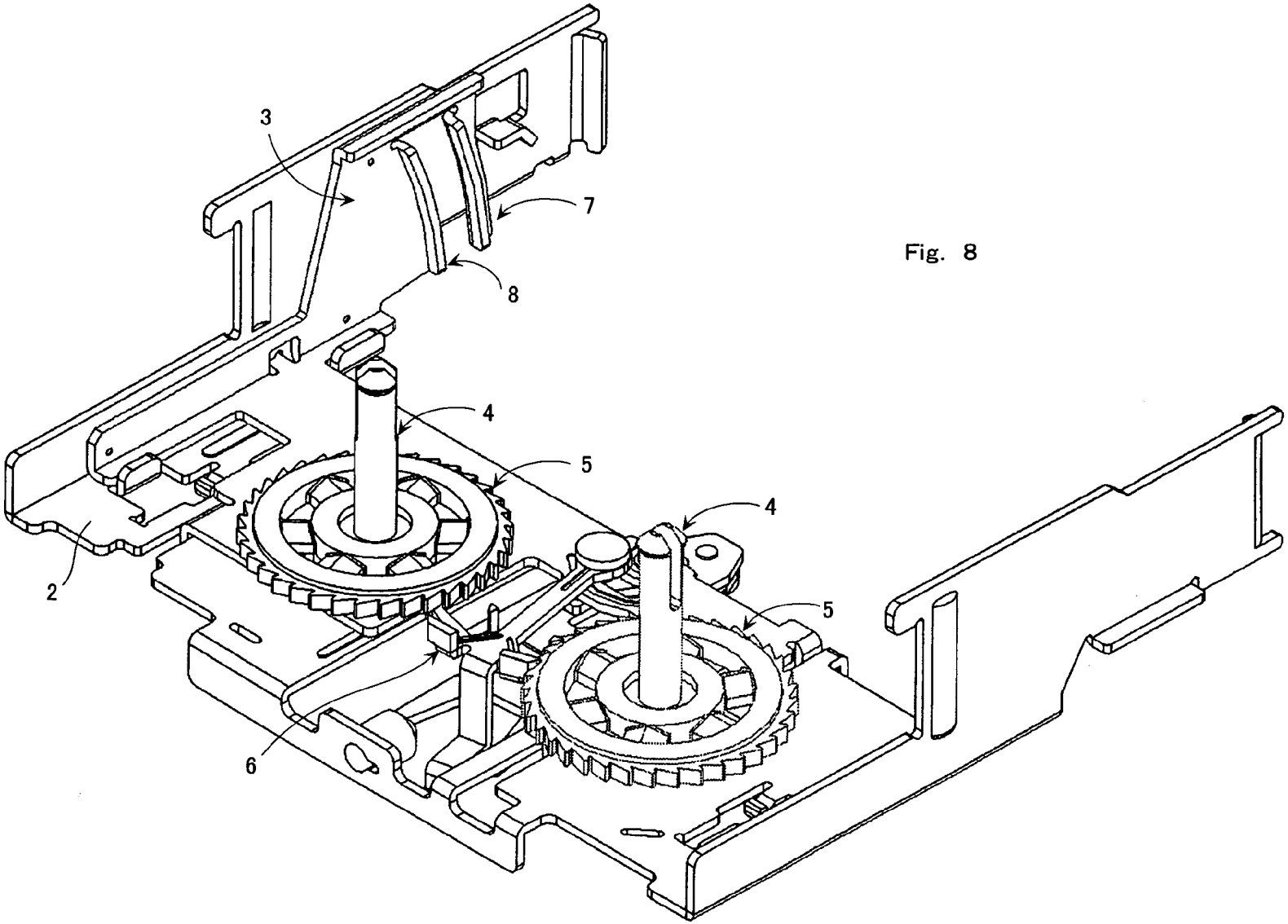
FIG. 8 is a diagram showing only the ribbon takeup mechanism according to the present invention.

FIG. 8 is a diagram showing only the ribbon takeup mechanism 1 according to the present invention. The ribbon frame 2 and the slide member 3 have a groove in which they slide, with the elastic member such as a tension spring, not shown, applying force to them into one direction. Referring to FIG. 8, the elastic member applies force to the slide member 3 into the right backward direction. This generates a driving force, required for ribbon feeding and feed claw switching, into the right backward direction with the feed claw 6 on the slide member 3 engaging the ratchet wheel 5 of the ribbon takeup axis 4 installed rotably on the ribbon frame 2.

The first engagement part 7 on the slide member 3 engages the displacement member 9 and applies motor driving force into the same direction as that into which the elastic member applies force. This motor driving force works with the elastic force of the elastic member to give the driving force required for ribbon feeding and feed claw switching.

On the other hand, the second engagement part 8 on the slide member 3 engages the displacement member 9 and applies motor driving force into the direction opposite to that into which the elastic member applies force. This slide member movement direction is the direction in which the feed claw 6 is moved to the position where the feed claw 6 engages the ratchet wheel 5 for the next ribbon feeding that will be performed after the current ribbon feeding or feed claw switching operation is finished. In this state, because the feed claw 6 does not engage the ratchet wheel 5, a large load is not applied to the slide member 3. Therefore, the slide member 3 can be moved only by the elastic force of the elastic member with no need for the engagement between the first engagement part 7 and the displacement member 9.

Next, with reference to FIGS. 9 to 12, the following describes the relation between the engagement parts and the displacement member when a ribbon is fed or the feed claw is switched.

Figure 9:
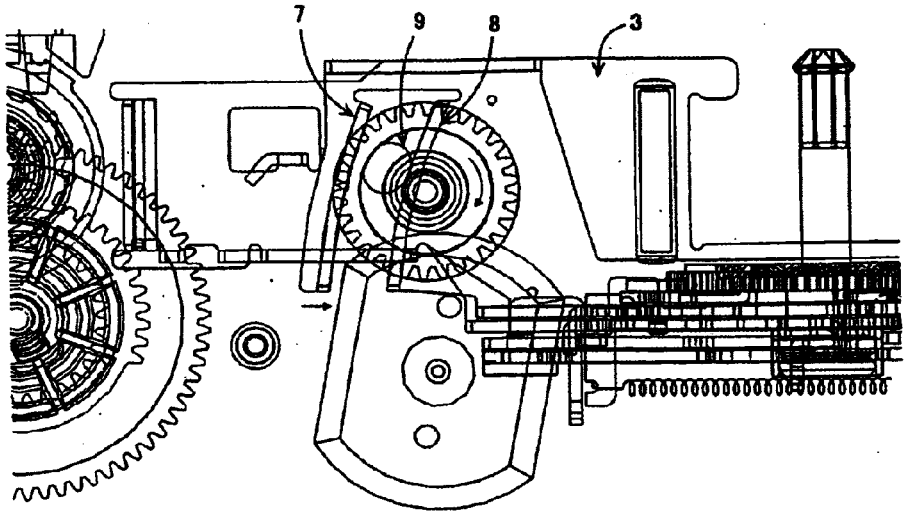
FIG. 9 is a diagram showing the relation between the engagement parts and the displacement member of the ribbon takeup mechanism according to the present invention.
Figure 9:
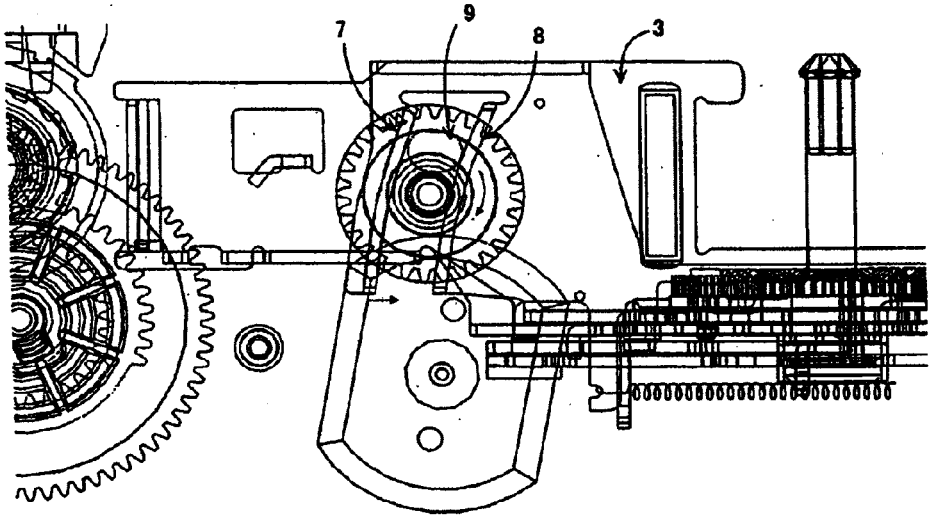
Figure 10:
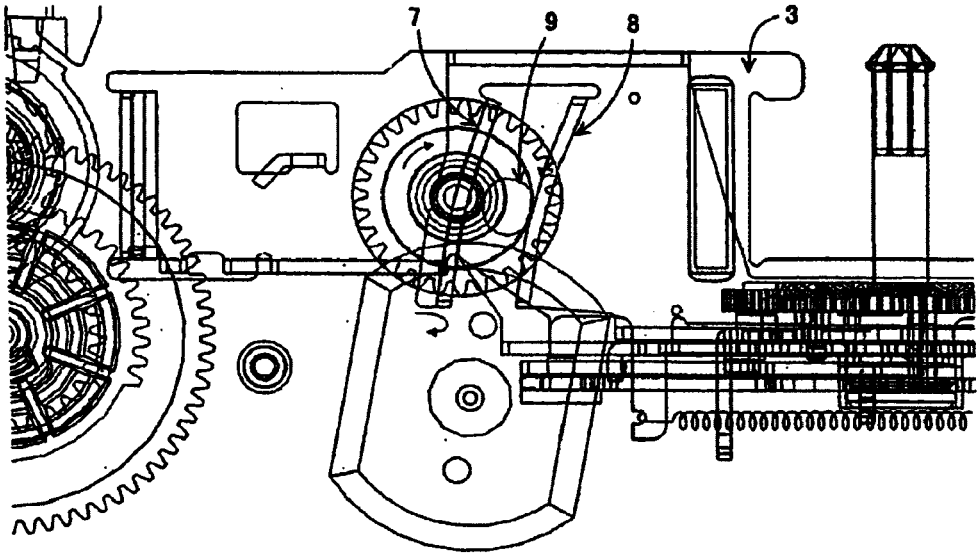
FIG. 10 is a diagram showing the relation between the engagement parts and the displacement member of the ribbon takeup mechanism according to the present invention.
Figure 10:
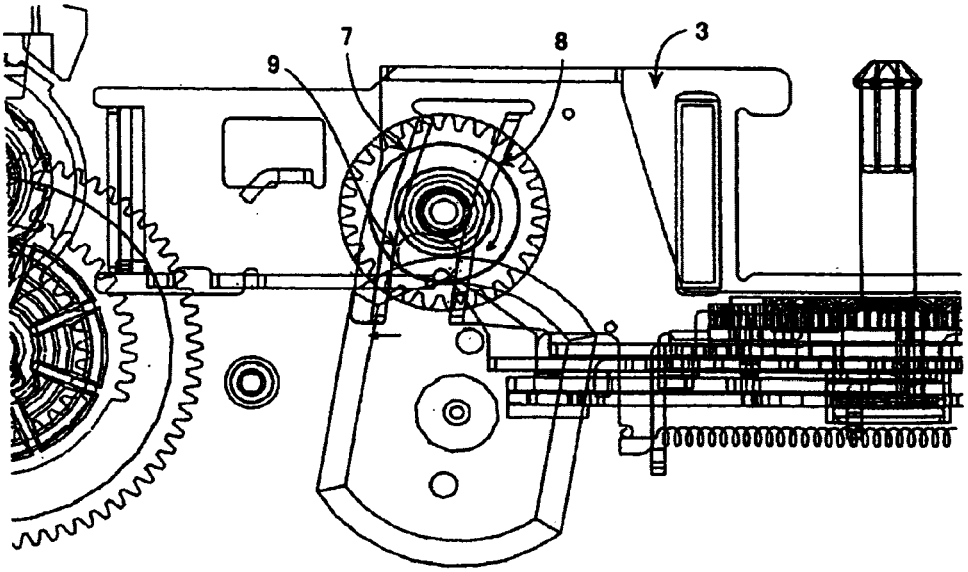
Figure 12:
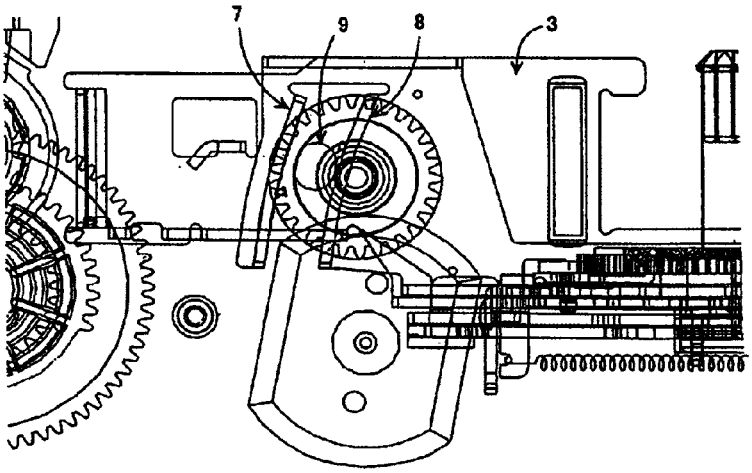
FIG. 12 is a diagram showing the relation between the engagement parts and the displacement member of the ribbon takeup mechanism according to the present invention.

First, with reference to FIGS. 9, 10, and 12, the following describes the relation between the engagement parts and the displacement member when a ribbon is fed.

FIG. 9(*a*) corresponds to FIGS. 2(*a*) and 2(*b*), FIG. 9(*b*) corresponds to FIGS. 2(*c*) and 2(*d*), FIG. 10(*a*) corresponds to FIGS. 2(*e*) and 2(*f*), FIG. 10(*b*) corresponds to FIGS. 2(*g*) and 2(*h*), and FIG. 12 corresponds to FIGS. 2(*a*) and 2(*b*).

The displacement member 9 engages the second engagement part 8 of the slide member 3 as the gear rotates and moves the slide member 3 to the right in the FIG. (to the left in FIG. 2) against the elastic force of the elastic member 15. At this time, the elastic member 15 is stretched if it is a tension spring, and the operation shown in FIGS. 9(*a*), 9(*b*), and 10(*a*) moves the feed claw to the direction in which it engages the ratchet wheel. After the feed claw engages the ratchet wheel, the operation shown in FIGS. 10(*a*) and 10(*b*) is performed to feed the ribbon.

Figure 11:
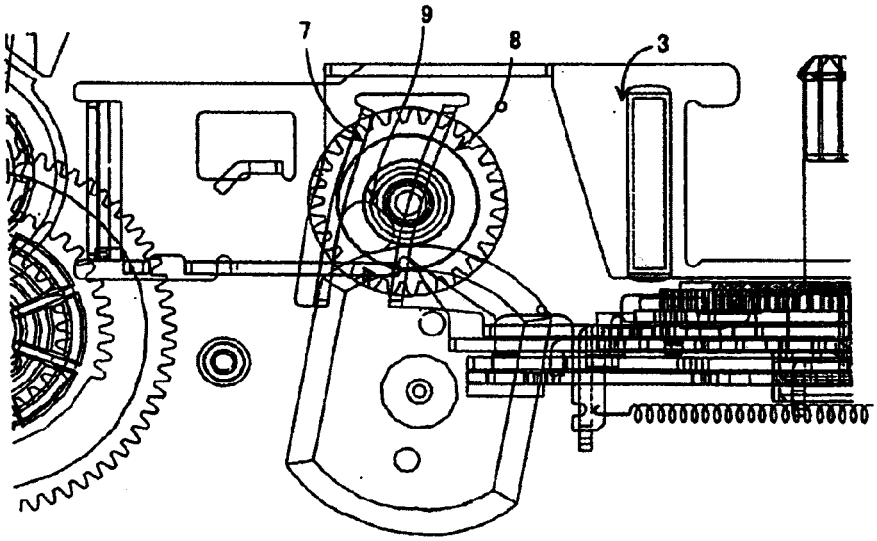
FIG. 11 is a diagram showing the relation between the engagement parts and the displacement member of the ribbon takeup mechanism according to the present invention.
Figure 11:
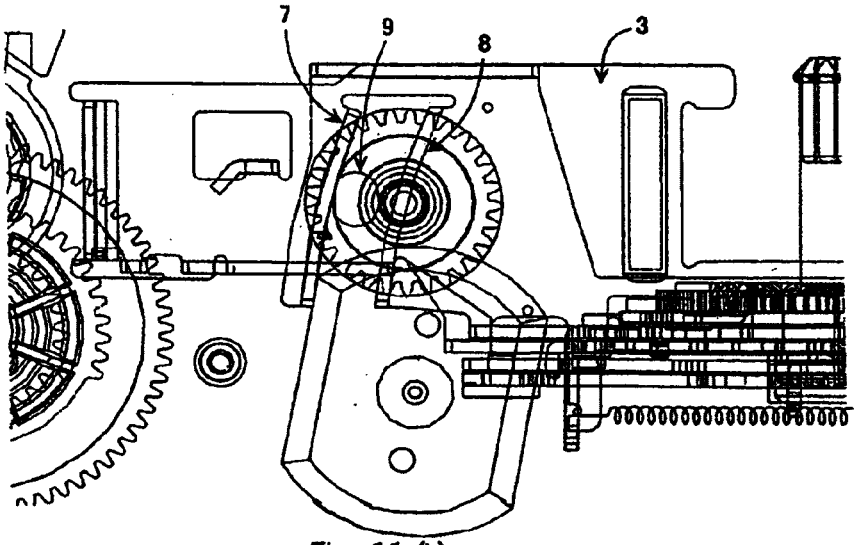

Next, with reference to FIGS. 9, 10, and 11, the following describes the relation between the engagement parts and the displacement member when the feed claw is switched.

FIG. 9(*a*) corresponds to FIGS. 2(A) and 2(B), FIG. 9(*b*) corresponds to FIGS. 2(C) and 2(D), FIG. 10(*a*) corresponds to FIG. 2(E), FIG. 11(*a*) corresponds to FIG. 2(F), FIG. 11(*b*) corresponds to FIG. 2(G), and FIG. 12 corresponds to FIGS. 2(A), 2(B), and 2(H).

The displacement member 9 engages the second engagement part 8 of the slide member 3 as the gear rotates and moves the slide member 3 to the right in the figure against the elastic force of the elastic member 15. At this time, the elastic member 15 is stretched if it is a tension spring. The operation shown in FIGS. 9(*a*), 9(*b*), and 10(*a*) moves the feed claw to the direction in which it engages the ratchet wheel.

After the feed claw engages the ratchet wheel, the operation in FIGS. 11(*a*) and 11(*b*) is performed to switch the feed claw by the resultant force of the motor driving force and the elastic force of the elastic member.

In the operation position shown in FIG. 12, there may be a clearance between the displacement member 9 and the second engagement part 8 of the slide member 3 or they may be in contact with each other.

As shown in FIG. 2(*a*) and FIG. 2(A), the operation position shown in FIG. 12 indicates that the slide member 3 is at one end to which the slide member 3 is moved by the elastic member 15. This position is where the position of the slide member 3 with respect to the ribbon frame 2 can be determined.

Therefore, when the displacement member 9 contacts the second engagement part 8 of the slide member 3 in the operation position shown in FIG. 12, the position of the slide member 3 depends on the position of the displacement member 9. On the other hand, when there is a clearance between the displacement member 9 and the second engagement part 8 of the slide member 3 and they are not in contact, the position of the slide member 3 is determined by the position of the ribbon frame 2 with no dependence on the displacement member 9 whose rotation position varies. FIG. 12 shows an example of the configuration in which a clearance is provided between the displacement member 9 and the second engagement part 8 of the slide member 3 so that the position of the slide member 3 can be determined by the positional relation with the ribbon frame 2 with no relation with the position of the displacement member 9.

The ribbon takeup device according to the present invention is advantageously applicable to a small printer.

What is claimed is:

1. A ribbon takeup device for taking up an inked ribbon, comprising:

ribbon takeup axes for taking up the inked ribbon;

a displacement member that moves to selectively rotate said ribbon takeup axes;

a motor that moves said displacement member; and a spring member that accumulates energy by said displacement member moving into a direction in which said ribbon takeup axes are not rotated and that releases the accumulated energy by said displacement member moving into a direction in which said ribbon takeup axes are rotated wherein, when said displacement member moves into a direction in which said ribbon takeup axes are rotated, said displacement member varies a ratio between a rotational driving torque by said spring member and a rotational driving torque by said motor according to a load state of said ribbon takeup axes.

2. The ribbon takeup device according to claim 1 wherein the load state is the state of a load required for taking up the inked ribbon and the state of a load required for switching a takeup direction.

3. The ribbon takeup device according to claim 1 or 2 wherein said displacement member applies the rotational driving torque of said motor when a load applied to said ribbon takeup axes exceeds a predetermined load.

4. The ribbon takeup device according to claim 1 or 2 wherein said displacement member applies only the rotational driving torque of said spring member when a load applied to said ribbon takeup axes does not exceed a predetermined load.

5. The ribbon takeup device according to claim 3 wherein the predetermined load is a load calculated by subtracting the rotational driving torque by said spring member from the load required for taking up the inked ribbon or the load required for switching the takeup direction.

6. A ribbon takeup device comprising:

ratchet wheels provided on ribbon takeup axes;

a feed claw that engages the ratchet wheels;

a displacement member that is driven and displaced by a motor so that at least a linear displacement is given;

a slide member that moves said feed claw, said slide member comprising a first engagement part that engages said displacement member when said feed claw moves into a direction in which the ribbon takeup axes are rotated and a second engagement part that engages said displacement member when said feed claw moves into an opposite direction of said direction; and an elastic member that applies force to said slide member into a direction in which said displacement member engages said first engagement part, wherein, in a period in which said slide member moves into a direction in which said elastic member applies the force, said displacement member switches the engagement with the second engagement part of said slide member according to a load applied to said ribbon takeup axes.

7. The ribbon takeup device according to claim 6 wherein, when the load applied to said ribbon takeup axes exceeds a predetermined load, said displacement member engages the first engagement part of said slide member to apply force to the slide member into a direction into which the force is applied and said feed claw is driven by a resultant force of an elastic force of said elastic member and a motor driving force.

8. The ribbon takeup device according to claim 7 wherein said ratchet wheels are provided, one for each of the ribbon takeup axes of a pair and the predetermined load is a load calculated by subtracting the elastic force of the elastic member from a load required for switching the ratchet wheel that engages the feed claw.

9. The ribbon takeup device according to claim 7 wherein the predetermined load is a load calculated by subtracting the elastic force of the elastic member from a load required by said ribbon takeup axes to take up the ribbon.

10. The ribbon takeup device according to claim 6 wherein, when the load applied to said ribbon takeup axes does not exceed a predetermined load, said displacement member disengages the first engagement part of said slide member to release the application of force into a direction into which force is applied to the slide member and said feed claw is driven only by an elastic force of said elastic member.

11. A printer with a ribbon takeup device comprising the ribbon takeup device according to claim 1.

* * * * *